United States Patent [19]

Rosof et al.

[11] 3,980,468

[45] Sept. 14, 1976

[54] METHOD OF PRODUCING A DUCTILE RARE-EARTH CONTAINING SUPERALLOY

[75] Inventors: Barry H. Rosof, Carmel; H. Joseph Klein; Dennis S. Acuncius, both of Kokomo, all of Ind.

[73] Assignee: Cabot Corporation, Kokomo, Ind.

[22] Filed: Nov. 1, 1973

[21] Appl. No.: 411,721

[52] U.S. Cl. ..... 75/10 R; 75/84; 75/129; 75/152

[51] Int. Cl.[2] ..... C22B 4/06; C22C 19/00

[58] Field of Search ..... 75/10–12, 75/84, 129, 152

[56] References Cited

UNITED STATES PATENTS

| | | | |
|---|---|---|---|
| 3,264,093 | 8/1966 | Sump | 75/152 |
| 3,295,963 | 1/1967 | Galvin | 75/152 |
| 3,551,137 | 12/1970 | Bhat | 75/94 |

FOREIGN PATENTS OR APPLICATIONS

| | | | |
|---|---|---|---|
| 979,583 | 1/1965 | United Kingdom | 75/10 |

OTHER PUBLICATIONS

Joseph & Mumau, "Electroflux Remelting Improves Properties of Inconel 718," Metal Producing Progress, pp. 139 et seq. (1967).

Hoyle & Lott, "A Brief Introduction to Electro–Slag Refining," BISRA (1965).

Duckworth & Hoyle, "Electro–Slag Refining," p. 154 (1969).

*Primary Examiner*—Peter D. Rosenberg

*Attorney, Agent, or Firm*—Buell, Blenko & Ziesenheim

[57] ABSTRACT

A method is provided for producing ductile superalloys containing rare-earth metals, lanthanum and yttrium by melting the desired alloy composition by conventional melt practices, adding the rare-earth metals, lanthanum or yttrium to the molten composition, forming the alloy composition into solid electrodes, remelting the solid electrode by electroslag remelting techniques and casting the remelted alloy.

4 Claims, 1 Drawing Figure

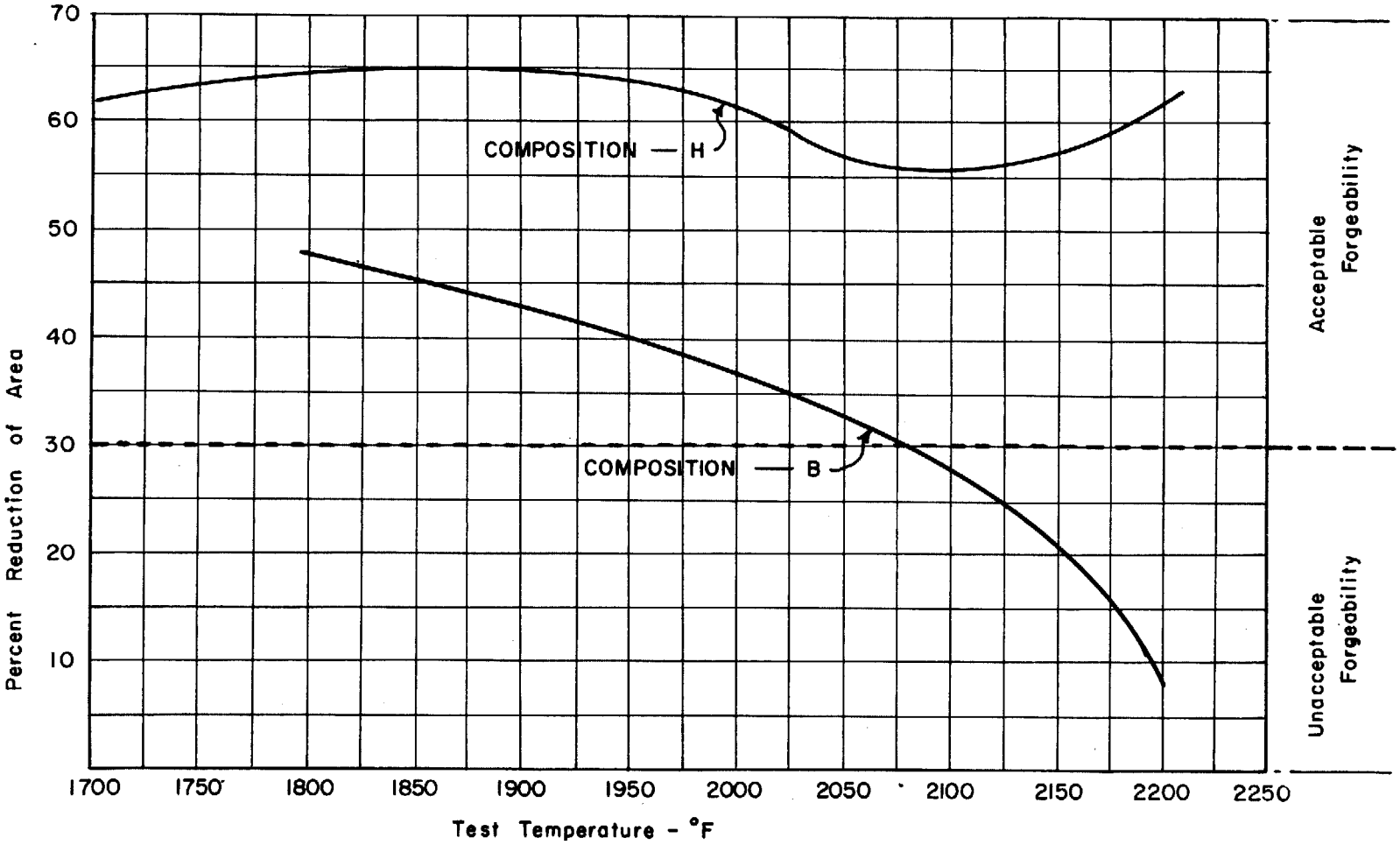
Acceptable Forgeability
Unacceptable Forgeability
COMPOSITION — H
COMPOSITION — B
Percent Reduction of Area
70
60
50
40
30
20
10
Test Temperature - °F
1700
1750
1800
1850
1900
1950
2000
2050
2100
2150
2200
2250

METHOD OF PRODUCING A DUCTILE RARE-EARTH CONTAINING SUPERALLOY

This invention relates to a method of producing a ductile rare-earth containing superalloy and particularly to a method of processing such superalloys with the addition of rare earths, lanthanum, and yttrium without embrittlement of the alloy.

Rare-earth elements and certain elements commonly classified with rare-earth elements such as lanthanum and yttrium are known to improve the high temperature oxidation properties of superalloys generally. Unfortunately, the addition of these elements to such superalloys without precautions often causes the alloy to become brittle. Since these superalloys are frequently used in wrought form such as sheet and other wrought products, such brittleness cannot be tolerated.

In order to simplify the terminology used in this application, the term "rare earth" or "rare-earth element" will be used hereafter to designate both the true rare-earth elements such as cerium and those elements which are frequently classified with them such as lanthanum and yttrium.

The term "brittle" is used herein in the following sense: Superalloys tend to crack during hot working. The tendency to crack is a function of the method of working and of brittleness, among other factors. An alloy with a high propensity to crack is said to be brittle, while an alloy with a low propensity to crack is said to be ductile. The severity of brittleness can be, to some degree quantified. This can be done either in terms of cracking propensity as measured by material yield or recovery through the working operation or in terms of ductility. The greater the brittleness, the greater the cracking and the lower the yields or recoveries of a particular hot working operation; thus recovery or yield is more or less indicative of the degree of brittleness, all other factors being equal. Alternately, a test which indicates ductility of the alloy such as a "Gleeble" test can be used to quantify the degree of brittleness. An apparatus for performing the Gleeble test is manufactured by Duffers Associates Inc. and identified as Gleeble Model 510. Such an instrument was used in obtaining ductility data set out below.

It is well known that rare-earth elements have limited solubility in the matrix phase of solid superalloys. As a consequence, the majority of the rare earth added to superalloys appears in secondary phases. The secondary phases in which the rare earth appears are of two main types, i.e., intermetallic phases and non-metallic phases, particularly oxides. We have found that the intermetallic phases are brittle and are believed to be the major contributing cause of brittleness in the alloy. Small amounts of oxide phase, on the other hand, do not appear to cause the alloy to exhibit marked brittleness, although the ductility does decrease as the percent of oxide present increases.

We have discovered that the brittleness characteristic of such rare-earth containing alloys can be eliminated or controlled by a double melt technique hereafter described.

It is, therefore, an object of this invention to provide an improved method of producing superalloys containing rare earth.

It is another object of this invention to provide superalloys and articles made of superalloys containing rare earths that have a relatively high degree of ductility.

Other objects, purposes and advantages of this invention will become apparent from a consideration of the following description.

Broadly, this invention comprises adding a rare earth either as a pure metal or in a master alloy to a primary superalloy melt, solidifying the melt, and remelting the solidified primary melt by the electroslag remelting process, commonly called the ESR process. In the first phase the rare earth may be added to the primary melt in any convenient manner. The resulting primary melt containing rare earth is then solidified in any convenient manner to provide stock for electroslag remelting. In this state the metal is usually brittle. The solidified primary melt is then remelted by the ESR process using any of the well-known slags and melt procedures within the field of the art. The remelted alloy is solidified and is ductile.

It is believed that the brittleness of the solidified primary melt is due to the formation of brittle rare-earth containing intermetallic phases. Although the exact mechanism is not understood, it is believed that the intermetallic phases are at least partly oxidized on remelting by the ESR process to form non-embrittling oxides and some are removed in the slag. Whatever the mechanism is, it appears to remove or alter those phases or portions of the rare-earth elements which cause "embrittlement" while retaining the high temperature oxidation resistance for which the rare earth was added.

The invention can perhaps be best understood and its beneficial effects evaluated by a consideration of the following examples of different superalloy composition and to the drawing which is a graph of test temperature vs. reduction of area for a composition melted by ESR techniques and a like composition melted by VAR techniques.

The compositions of these various alloys at different processing stages are set out in Table I.

TABLE I

ALLOY COMPOSITIONS

| | N - 1 | | N - 2 | | | | N - 3 | | N - 4 | |
|---|---|---|---|---|---|---|---|---|---|---|
| Element | Electrode | Ingot (VAR) | Electrode | Ingot (VAR) | Ingot NO. 2 | Ingot NO. 3 | Electrode | Ingot NO. 3 | Electrode | Ingot |
| Composition | A | B | C | D | E | F | G | H | I | J |
| Ni | Bal. | Bal. | Bal. | Bal. | Bal. | Bal. | Bal. | Bal. | Bal. | Bal. |
| Co | 0.09 | 0.9 | 0.11 | 0.10 | — | — | 0.11 | 0.10 | .26 | .26 |
| Fe | 0.93 | 0.91 | 0.84 | 0.85 | 0.88 | 0.89 | 0.73 | 0.81 | 0.59 | 0.61 |
| Cr | 12.95 | 12.85 | 14.30 | 14.25 | 14.35 | 14.42 | 16.59 | 16.35 | 12.48 | 12.40 |
| Mo | 15.11 | 15.30 | 14.53 | 14.58 | 14.66 | 14.53 | 15.30 | 15.17 | 7.99 | 7.92 |
| W | 0.12 | 0.16 | 0.14 | 0.14 | — | — | 0.07 | 0.07 | 15.00 | 14.93 |
| Ti | | | | | | | | | | |
| Al | 0.21 | 0.21 | 0.18 | 0.18 | 0.13 | 0.13 | 0.21 | 0.20 | 0.20 | 0.22 |
| C | 0.006 | 0.008 | 0.006 | 0.007 | 0.005 | 0.005 | 0.006 | 0.008 | 0.010 | 0.02 |
| B | 0.031 | 0.03 | 0.009 | 0.009 | 0.012 | 0.006 | 0.013 | 0.011 | 0.009 | 0.008 |

TABLE I-continued

| | | | | | | | | | | |
|---|---|---|---|---|---|---|---|---|---|---|
| Si | 0.03 | 0.03 | 0.02 | 0.02 | 0.01 | 0.02 | 0.05 | 0.05 | 0.36 | 0.37 |
| Mn | 0.05 | 0.04 | 0.04 | 0.05 | 0.04 | 0.04 | 0.21 | 0.20 | 0.53 | 0.52 |
| La | 0.13 | 0.10 | 0.14 | 0.12 | 0.02 | 0.02 | 0.12 | 0.013 | 0.09 | 0.02 |
| Y | | | | | | | | | | |

| | N - 5 | | N - 6 | | N - 7 | | N - 8 |
|---|---|---|---|---|---|---|---|
| Element | Electrode | Ingot | Electrode | Ingot | Electrode | Ingot | Ingot |
| Composition | K | L | M | N | O | P | |
| Ni | Bal. | Bal. | Bal. | Bal. | Bal. | Bal. | Bal. |
| Co | 19.26 | 19.68 | 40.80 | 40.80 | 39.0 | 39.20 | – |
| Fe | — | – | 1.48 | 1.48 | 1.96 | 1.98 | — |
| Cr | 19.61 | 19.55 | 21.40 | 21.40 | 21.50 | 21.80 | 16.00 |
| Mo | 6.21 | 6.34 | 0.13 | 0.13 | 0.43 | 0.43 | — |
| W | – | – | 14.05 | 14.05 | 13.85 | 13.85 | – |
| Ti | 2.04 | 2.21 | – | – | – | – | — |
| Al | 0.55 | 0.46 | 0.25 | 0.22 | 0.23 | 0.11 | 5.0 |
| C | 0.08 | 0.07 | 0.09 | 0.09 | 0.10 | 0.10 | — |
| B | – | — | — | – | — | — | — |
| Si | 0.24 | 0.25 | 0.41 | 0.40 | 0.35 | 0.34 | — |
| Mn | 0.39 | 0.37 | 0.76 | 0.76 | 0.70 | 0.70 | — |
| La | 0.12 | 0.05 | 0.05 | 0.03 | 0.13 | 0.04 | — |
| Y | | | | | | | 0.03 |

TABLE II

| ALLOY | AVERAGE OXIDATION RATES AT 2000°F METAL LOSS, MILS/100 HRS. |
|---|---|
| B | 0.19 |
| F | 0.16 |
| H | 0.13 |

EXAMPLE 1

Approximately 10,000 pounds of an alloy of composition A was melted. Lanthanum was added as a Ni-La master alloy and the metal cast as an electrode for remelting. The solidified electrode was vacuum arc remelted. Its composition was composition B of Table I after remelting. An attempt was made to forge the remelted ingot. The metal, however, was brittle and no useful product was obtained.

EXAMPLE 2

An alloy heat of approximately 10,000 pounds was processed in the same manner as Example 1. The resulting electrode had the composition C of Table I. After vacuum arc remelting, the alloy had composition D of Table I. On forging, large cracks appeared in the ingot. The cracked ingot was divided into two pieces and each piece was separately melted by the ESR process and cast. The first piece was processed using a pure $CaF_2$ slag. The composition was composition E of Table I. The second piece was processed using a 70% $CaF_2$, 15% CaO, 15% $Al_2O_3$ slag. The resulting ESR composition was composition F. Both of these ESR remelted pieces showed excellent forgeability and useful wrought product was obtained.

EXAMPLE 3

A 10,000 pound electrode of composition G was made as described in Example 1. It was ESR remelted to provide composition H of Table I. The resulting solidified metal showed excellent ductility.

Gleeble ductilities for the final product (composition B) of Example 1 and the final product (composition H) of Example 3 were obtained. These ductility values are shown in the Figure. The ESR composition (H) shows much better ductility than the VAR composition (B).

Static oxidation tests were performed on the compositions B, F and H. The results of these oxidation tests are set out in Table II. As can be seen from these tests, there is no degradation of oxidation properties due to ESR remelting.

EXAMPLE 4

An alloy of composition I was melted. Lanthanum was added to the melt as a Ni-La master alloy prior to tapping the furnace. The alloy was cast as an electrode for remelting, solidified and ESR remelted to provide composition J of Table I. The resulting material displayed excellent forgeability and was processed into rings by hammer forging. The forged rings were tested successfully in a gas turbine engine.

EXAMPLE 5

A 100 pound heat of composition K was melted. Lanthanum was added as pure lanthanum metal to the metal in the furnace prior to tapping. The metal was cast as an electrode for remelting. The electrode was then ESR remelted and cast as a six inch diameter ingot of composition L, forged to plate and rolled to sheet. The alloy showed excellent ductility, was readily worked and produced a satisfactory sheet product.

EXAMPLE 6

An alloy heat N-6 of approximately 10,000 pounds with composition M as shown in Table I was melted. Lanthanum was added to the melt as nickel lanthanum. The ingot was subsequently vacuum arc remelted and forged. The ingot composition was then N. On forging the VAR ingot broke up and no useful product was obtained. A second heat N-7 was made of composition O. This heat was electroslag remelted and forged. The ingot had excellent hot workability and a useful wrought product was obtained. The ingot's, P, composition is shown in Table I.

EXAMPLE 7

Ni-Cr-Al-Y alloys of the general composition N-8 were processed as in Example 6 with like results.

In the foregoing specification we have set out certain preferred practices and embodiments of this invention, however, it will be understood that this invention may be otherwise embodied within the scope of the following claims.

We claim:

1. The method of producing rare-earth containing super-alloys having as their major components nickel, cobalt and chromium in combination characterized by enhanced ductility and substantial freedom from brittleness comprising:

a. melting the desired super alloy composition;

b. adding the desired rare-earth alloy to the molten alloy composition;

c. forming the alloy composition into solid electrodes; and d. remelting said solid electrodes by electroslag remelting.

2. The method as claimed in claim 1 using a substantially pure calcium fluoride slag in step (d) of claim 1.

3. The method as claimed in claim 1 using a slag of about 70% $CaF_2$, 15% CaO and 15% $Al_2O_3$ in step (d) of claim 1.

4. The method as claimed in claim 1 where the superalloy composition is first melted and the rare earth added as a master alloy with nickel.

* * * * *